US011349245B2

(12) United States Patent
Noll et al.

(10) Patent No.: US 11,349,245 B2
(45) Date of Patent: May 31, 2022

(54) ARRANGEMENT OF COMPONENTS FOR TRANSFERRING ELECTRIC CURRENT

(71) Applicant: WIELAND-WERKE AG, Ulm (DE)

(72) Inventors: Tony Robert Noll, Dietenheim (DE); Gerhard Thumm, Erbach (DE); Volker Voggeser, Senden (DE); Michael Wolf, Ulm (DE); Christoph Kästle, Ulm (DE); Jochen Walliser, Ulm (DE)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 17/179,714

(22) Filed: Feb. 19, 2021

(65) Prior Publication Data

US 2021/0281002 A1 Sep. 9, 2021

(30) Foreign Application Priority Data

Mar. 3, 2020 (DE) ..... 10 2020 001 379.1

(51) Int. Cl.
*H01R 13/24* (2006.01)
*H01R 4/26* (2006.01)

(52) U.S. Cl.
CPC ..... *H01R 13/2457* (2013.01); *H01R 4/26* (2013.01)

(58) Field of Classification Search
CPC ..... H01R 4/26
See application file for complete search history.

(56) References Cited

U.S. PATENT DOCUMENTS 2,946,039 A * 7/1960 Grunwald ..... H01R 4/34 439/801
3,678,445 A * 7/1972 Brancaleone ..... H01R 13/6596 439/607.17

(Continued)

FOREIGN PATENT DOCUMENTS

DE 148159 2/1904
DE 3412849 A1 10/1984

(Continued)

OTHER PUBLICATIONS

Office Action of European Patent Office issued in corresponding European Patent Application No. 21 00 0044.4 dated Jul. 14, 2021 (8 pages).

*Primary Examiner* — Ross N Gushi
(74) *Attorney, Agent, or Firm* — Flynn Thiel, P.C.

(57) ABSTRACT

An arrangement of components for transferring electric current from a current-feeding component to a current-discharging component, including a first component, which feeds current to the arrangement or discharges current from the arrangement. The first component includes a first metallic material and, on at least one surface, has at least one spring lamella composed of the first metallic material and machined out of the first metallic material at the surface. The lamella is machined out of the first metallic material at the surface of the first component such that it is connected monolithically to the first component in a connecting region and, starting therefrom extends as far as a free end and, when deflected out of a rest position toward the surface of the first component, exerts a spring force directed away from the surface. A second component is in immediate contact with the lamella of the first component.

11 Claims, 4 Drawing Sheets

(56) References Cited

U.S. PATENT DOCUMENTS

| | | | | |
|---|---|---|---|---|
| 4,750,897 | A | 6/1988 | Neidecker | |
| 9,401,570 | B2 * | 7/2016 | Phillips | H01R 13/6583 |
| 10,103,468 | B2 * | 10/2018 | Kovalov | H01R 13/03 |
| 2020/0227850 | A1 * | 7/2020 | Do | H01R 13/2407 |

FOREIGN PATENT DOCUMENTS

| | | | |
|---|---|---|---|
| DE | 102007030134 | B3 | 10/2008 |
| DE | 102013015088 | A1 | 3/2015 |
| EP | 0202564 | A2 | 11/1986 |
| EP | 0856913 | A1 | 8/1998 |
| JP | 569866 | U | 9/1993 |
| WO | 2016187089 | A1 | 11/2016 |

* cited by examiner

ARRANGEMENT OF COMPONENTS FOR TRANSFERRING ELECTRIC CURRENT

CROSS-REFERENCE TO RELATED APPLICATIONS

This claims priority from German Application No. 10 2020 001 379.1, filed Mar. 3, 2020, the disclosure of which is hereby incorporated by reference in its entirety.

TECHNICAL FIELD

The invention relates to a system for transferring electric current from a first component to a second component, wherein the first component is in electric contact with the second component. Such contact systems are used in the interconnection of battery modules, for example. In this context, the contact systems must be configured in such a way that they can transfer currents with a current intensity of up to 500 A without a large voltage drop. The total resistance of the contact system must therefore be as low as possible.

BACKGROUND AND SUMMARY

The two components generally have a clearance which must be bridged by a contact element. To ensure that the transfer resistance between the contact element and a component is as low as possible, the contact element must be pressed against the surface of the component with a minimum force. Contact elements therefore often have a spring mechanism, which ensures the required contact pressure between the contact element and the component. The contact pressure must be maintained over the entire life of the system to ensure that a rise in the contact resistance is avoided. Moreover, the contact element must be able to balance out manufacturing tolerances in the components and to compensate for thermal expansion and vibration.

Fundamentally, it should be possible to release again the electric connection provided by the contact system between the components when the components are separated from one another. In some cases, however, the aim is that the electric connection should be maintained when the components change their position relative to one another, especially when the clearance between the components increases due to unwanted external influences. In these cases, the connection between the components should be almost impossible to release, i.e. it should be possible to release it again only with considerable effort.

DE 148 159 A discloses a device for producing releasable connections for electric lines. A plate composed of flexible material and provided with a multiplicity of raised portions is provided between the lines to be connected. The raised portions can take the form of humps.

DE 34 12 849 A1 discloses an electric contact device that has a pressure-loaded intermediate contact layer. The intermediate contact layer has projecting parts and can have a corrugated or arched shape. The intermediate contact layer is composed of a material with the hardness of a spring.

Moreover, EP 0 202 564 A2 discloses an electric contact device that has at least two contact bodies and at least one lamellar body. The lamellar body comprises a multiplicity of arched lamellae, which are separated from one another by slots. The lamellae operate according to the principle of a leaf spring.

The disadvantage with spring elements of this kind, which are installed as an additional part between two components, is that the current must first of all be transferred from a first component to the spring element and then from the spring element to a second component. The contact system thus has at least two contact points with a considerable transfer resistance.

It is the underlying object of the invention to indicate an improved system for making contact between current-carrying components, i.e. for transferring electric current from a first to a second component. In particular, the system should be suitable for current intensities between 10 A and 500 A, have a low transfer resistance and be capable of being produced in a simple and low-cost way.

The invention includes an arrangement of components for transferring electric current from a current-feeding component to a current-discharging component. The arrangement comprises a first component, which is the component feeding current to the arrangement or is the component discharging current from the arrangement. The first component comprises a first metallic material and, on at least one surface, has at least one spring lamella composed of the first metallic material and machined out, in particular formed out, of the first metallic material at said surface. The at least one lamella is machined out of the first metallic material at the surface of the first component in such a way that it is connected monolithically to the first component in a connecting region and, starting from said connecting region, extends as far as a free end. If the lamella is deflected out of its rest position in a direction perpendicular to the surface of the first component, it exerts a spring force directed away from the surface of the component. This spring force comprises a component which is directed perpendicularly to the surface of the first component, i.e. a normal spring force. Furthermore, the arrangement comprises a second component, which is in immediate, i.e. direct, contact with the at least one lamella of the first component. Thus, the first component not only has the function of connecting the arrangement to further components of a circuit which do not belong to the arrangement but simultaneously serves to establish electric contact with the second component by means of at least one spring lamella.

When, in order to describe the invention, the at least one lamella of the first component is set in relation, in respect of its position or alignment, to the surface of the first component, it is the outer surface of the first component that would result if the at least one lamella were removed that is understood as the surface of the first component.

A lamella can be taken to mean a band-, strip- or plate-shaped material projection of thickness D, width B and length L. Here, the length L of the lamella is measured along the connecting region, in which it is connected monolithically to the first component. The width B of the lamella is measured from the connecting region to the free end of the lamella. The thickness D is measured perpendicularly to the surface of the lamella, i.e. perpendicularly to the length and width. Usually, the width B and the length L are each greater than the thickness D. The thickness D of the lamella can be 0.05 to 0.6 mm, preferably 0.1 to 0.3 mm. The lamella projects from the surface of the first component, i.e. rises above the surface of the first component. The height of the lamella can be defined as the distance between a point at which the lamella is connected to the first component and its free end, wherein this distance is measured perpendicularly to the surface of the first component. The height of the lamella is 0.1 to 5 mm, preferably 0.2 to 2.5 mm.

Thus, the invention relates to the direct transfer of electric current from a first component, which is the component feeding current to the system or the component discharging current from the system, to a second component by at least one spring contact element that is machined in the form of a lamella out of the surface of the first component. The spring contact element is connected monolithically to the first component. It is thus an integral constituent of the first component. There is therefore no electric transfer resistance between the first component and the lamella. If the first component is brought into contact with the second component at the surface which has at least one lamella, the spring lamella is deflected out of its rest position in a direction toward the first component. As a reaction, it exerts a normal spring force on the second component. Force-actuated electric contact is thereby established between the first component and the second component by means of the lamella. The magnitude of normal spring force can be set by means of the geometry of the lamella, the slope angle thereof relative to the surface of the first component, and the choice of the material for the lamella. Metallic materials with a high modulus of elasticity are particularly suitable as materials for the lamella.

The particular advantage of this arrangement of components is that, through the integration of the lamellar spring contact element into the first component, a transfer resistance between said component and the contact element is avoided and thus the total electric resistance of the arrangement is significantly reduced. Furthermore, it is no longer necessary to insert a separate contact element, e.g. a lamellar strip, between the first and the second component. The number of parts that are necessary is thus reduced, thereby lowering effort and costs. The first component already comprises the contact element for making contact with the second component. The entire arrangement is easier to install and more reliable in its functioning since a separate contact element no longer has to be inserted between the current-carrying components and thus also cannot accidentally be forgotten or fall out. Moreover, the arrangement is distinguished by a compact construction and a small space requirement.

In the region of the contact point with the other component, at least one of the two components can advantageously have a metallic coating, which can comprise silver, gold, tin and/or nickel, for example. By means of such a coating, the transfer resistance between the components is reduced. Frictional forces and wear are likewise minimized. Furthermore, the coating prevents corrosion at the surface of the component, and it can also act as a diffusion barrier for the metallic base material of the component.

In particular, the first component can be a busbar. A busbar is a rigid, preferably one-piece, component composed of an electrically conductive material, in particular from metal, which is used to transfer and distribute electric currents. A busbar can be a straight flat profile, for example, but it can also be a bent or angled flat profile. However, the profile of the busbar can also have other shapes, e.g. a U shape or L shape, or it can be round. A busbar has at least two contact regions, namely at least one for current feed and at least one for current discharge. If a busbar is used as a first component in the arrangement according to the invention, it has at least one spring lamella of the kind described above in at least one of its contact regions. By means of this lamella, a contact with a second component, which can likewise be a busbar, is established. The other contact region of the busbar can have any desired means for making contact with a further electric component not belonging to the arrangement, e.g. clamping devices, recesses or holes, which may optionally have an internal thread. As a particular preference, the busbar can have a plurality of contact regions, which each have at least one spring lamella. Such a busbar can be used to distribute currents, e.g. in a power storage device to distribute partial currents to individual storage modules.

In a preferred embodiment of the invention, it is possible for only the first component and the second component to be situated in the current path of the arrangement. The arrangement thus comprises no further components in the current path: the first component is the component that feeds current to the arrangement or the component that discharges current from the arrangement, while the second component is the current-discharging or current-feeding component complementary to the first component in terms of current flow. In respect of the current-carrying components, the arrangement thus consists only of the first and the second component. In other words, the current path within the arrangement in this embodiment consists only of the first component and the second component. By means of such an arrangement, a system for making contact between two current-carrying components that has just one mechanical contact point in the current path is provided.

In the context of this preferred embodiment of the invention, however, the possibility that the entire arrangement comprises further components outside the current path, e.g. devices for positioning and installing the first and the second component, is not excluded. It is likewise possible for the first or the second component to be connected outside the arrangement to other electric or electronic components, e.g. to a resistor, a switch, a relay or a contactor.

The at least one lamella can advantageously be machined out of the first metallic material of the first component by means of a separating process, in particular a cutting, chiseling, peeling, plowing or furrowing process, and by means of a bending process. The lamella is formed from a material layer which has been machined out of the original surface of the first component in such a way by a suitable separating process that the material layer is not separated completely from the surface but remains monolithically connected to the first component in a connecting region. This material layer is raised from the surface of the first component by a bending process in that the material layer is bent around an imaginary axis that extends along the connecting region. The separating and bending process can also be carried out in a single work step. The lamella is thus formed from the material at the surface of the first component and forms a material projection. The advantage of this embodiment is that high material utilization is achieved since there is no punching waste in the production of the spring lamellae, for example.

In the context of this advantageous embodiment, the above-described metallic coating of the component can be applied to the surface of the first component in the region of the contact surface before the at least one lamella is machined out of the material of the first component.

In the context of one specific configuration of this advantageous embodiment of the invention, it is furthermore possible for the first metallic material of the first component to have a greater hardness in the connecting region than outside the connecting region. The connecting region can also be referred to as the base of the lamella. Owing to the separating and bending process during the machining out of the lamella, the material has been plastically deformed there. This leads to local hardening of the material in the connecting region. The material therefore has a higher strength and higher hardness locally. The higher strength has the advantage that the lamella can exert a higher spring force without being plastically deformed. The spring effect is thereby improved, and the transfer resistance in the contact region is reduced.

In another advantageous embodiment of the invention, the at least one lamella can extend obliquely at an angle $\alpha$ of less than 80° to the surface of the first component in the rest position. The slope angle $\alpha$ is measured at the point of origin of the lamella at the surface of the first component, i.e. in the connecting region. The sloping arrangement of the lamella relative to the surface of the component enables the spring effect of the lamella to be achieved in an effective way.

In the context of one specific configuration of this embodiment, the angle $\alpha$ at which the lamella extends relative to the surface of the first component in the rest position can be 40° to 70°. If the angle $\alpha$ is less than 40°, the maximum deflection of a lamella out of its rest position is too small to produce a sufficiently high spring force. If the angle $\alpha$ is greater than 70°, the component of the spring force perpendicular to the surface of the first component is relatively small, and therefore only a small normal spring force acts in the case of small deflections of the lamella.

In a particularly advantageous embodiment of the invention, the at least one lamella can have a convex contour between the connecting region and the free end of the lamella on its side facing away from the surface of the first component. In particular, the lamella can have a convex curvature or a kink that results in a convex outer contour of the lamella. In the case of a convex curvature of the lamella, the angle which the tangent to the lamella encloses with the surface of the first component is modified in such a way that this angle becomes smaller with increasing distance from the base of the lamella. In the case of a convex kink, the tangential angle in the region between the kink and the free end of the lamella is smaller than in the region between the base of the lamella and the kink. The convex contour of the lamella enlarges the area by means of which the lamella can be in contact with the second component. Consequently, the advantage of this embodiment is a high spring force of the lamella simultaneously combined with a large contact area with the second component.

In another preferred embodiment, the at least one lamella can be divided, in particular divided transversely, into a plurality of segments, starting from its free end. The segments formed in this way are arranged adjacent to one another in the longitudinal direction of the lamella. Upon contact with the surface of the second component, the individual segments can be deflected by different amounts out of their respective rest position. By dividing the lamella into adjacent segments, it is consequently possible to compensate more effectively for irregularities in the surface of the second component than in the case of an undivided lamella.

The first component can advantageously be composed at least partially of a metallic composite material, which comprises the first metallic material and a second metallic material, wherein the second metallic material has a higher electric conductivity than the first metallic material. In the case of a composite material of this kind, the two functions of the first component, namely current transfer, on the one hand, and provision of a spring contact element, on the other hand, are assisted by the use of different materials. The first metallic material, which forms the outer layer of the first component, has good strength and spring properties and is thus optimized for the function of the spring lamella. The predominant proportion of the volume of the first component consists of the second metallic material. Owing to its high electric conductivity, this material contributes to a low electric resistance of the arrangement. Since no spring lamella is formed from this second material, it is acceptable if its strength and spring properties are poorer than those of the first metallic material. The first metallic material can be, in particular, a special copper alloy, while the second metallic material can be, in particular, high-purity copper or aluminum.

Furthermore, the metallic composite material is distinguished by the fact that the first and the second material are connected to one another in such a way that, when current flows via the interface between these two materials, there is no significant electric resistance at the interface. In particular, the first and the second metallic material can be connected in a materially bonded manner. This can be accomplished by means of a plating process, for example. In order to reduce the transfer resistance between the first and the second metallic material, a coating, which comprises silver, gold, tin and/or nickel, for example, can furthermore be provided.

In an advantageous embodiment of the invention, the first component can have an electrically insulating layer, which is at least partly removed on the side of the lamella which faces away from the surface of the first component. By means of an insulating layer of this kind, the first component is electrically insulated over a large part of its surface, and only those locations on the surface of the first component which are in contact with the second component are exposed. The safety of the overall arrangement is thereby improved. To produce such an embodiment, a pre-insulated profile or a pre-insulated busbar can be used, for example.

In a preferred embodiment of the invention, the second component can be composed at least partially of a metallic material and, on at least one surface, can have at least one spring lamella composed of the metallic material. In this case, the lamella is machined out of the metallic material at the surface of the second component in such a way that it is connected monolithically to the second component in a connecting region and, starting from the connecting region, extends as far as a free end. The at least one lamella of the second component is in contact with the at least one lamella of the first component. In this embodiment, therefore, both the first component and the second component each have at least one spring lamella for making contact with the other component. Mutually opposite lamellae of the two components can be in electric contact. In this way, a larger spring travel is formed than if only one of the components had spring lamellae. In this way, it is also possible to reliably bridge large clearances between the first and the second component. In respect of the configuration of the at least one spring lamella of the second component, attention is drawn explicitly to the embodiments of the at least one spring lamella of the first component.

In the context of one specific configuration of this preferred embodiment, the at least one lamella of the first component can be in contact with the at least one lamella of the second component in such a way that the first component remains connected to the second component when the components change their position relative to one another, in particular, when the clearance between the components increases. In this case, the lamellae are configured in such a way that the first component is connected to the second component in such a way that it is virtually impossible to release or almost impossible to release, i.e. can be released only with considerable effort. The lamellae of the two components can latch into one another or hook into one another, for example. The advantage of this specific embodiment is that the electric contact between the first and the second component is maintained in a particularly reliable manner. The clearance between the first and the second component may accidentally increase due to external influences, e.g. vibrations or thermal expansion. In this specific embodiment of the invention, the electric contact between the two components is maintained even in these cases.

In respect of further technical features and advantages of the arrangement according to the invention, attention is hereby drawn explicitly to the figures, the description of the figures and the illustrative embodiments.

BRIEF DESCRIPTION OF THE DRAWINGS

Illustrative embodiments of the invention are explained in greater detail by means of the schematic drawings. In the drawings.

In all the figures, mutually corresponding parts are provided with the same reference signs.

DETAILED DESCRIPTION

Figure 1:
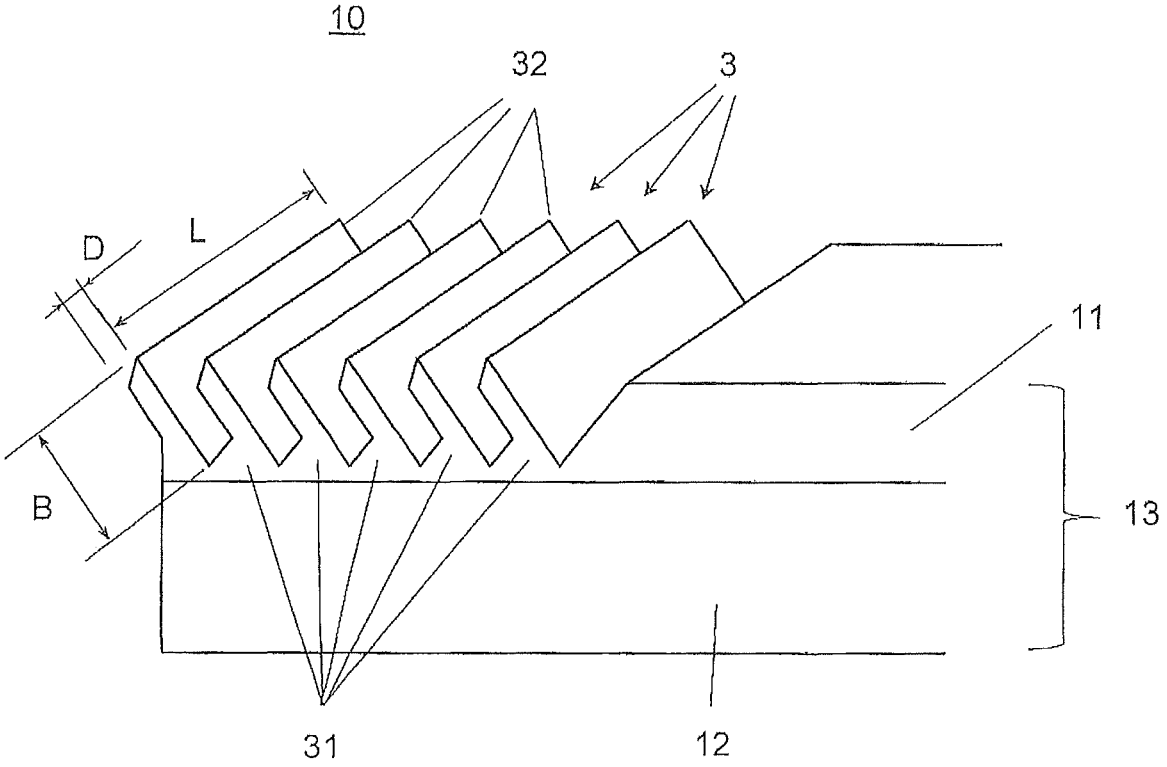
FIG. 1 shows schematically a first component having linear lamellae.

FIG. 1 shows schematically a first component 10 having six lamellae 3. The component 10 comprises a metallic composite material 13, which is composed of a first metallic material 11 and of a second metallic material 12. The two materials 11 and 12 can be connected to one another by roll bonding. The second metallic material 12 has a higher electric conductivity than the first metallic material 11 and accounts for the predominant proportion of the volume of the first component 10. Only at the surface of the first component 10 is there a layer of the first metallic material 11. The lamellae 3 are machined out of this first metallic material 11. The lamellae 3 are each connected in a connecting region 31 to the first component 10 and extend from the surface of the first component 10 to a free end 32. The lamellae 3 slope relative to the surface of the first component 10. The slope of the lamellae 3 remains the same as far as the free end 32 thereof. The lamellae have neither a kink nor a curvature. They thus extend in a linear manner.

The lamellae 3 each have the shape of a strip and have a length L, a width B and a thickness D. The width B is measured from the base of a lamella 3 at the connecting region 31 to its free end 32. The lamellae 3 extend over the entire width of the component 10. The current carrying capacity of the spring contact can be set by means of the distance between adjacent lamellae 3. Irrespective of the precise embodiment of the lamellae 3, the distance between adjacent lamellae can be 0.1 to 15 mm.

The first component 10 furthermore has a region in which there are no lamellae. In this region, there can be means (not illustrated) for making contact with other electric conductors, e.g. holes with screw fasteners.

Figure 2:
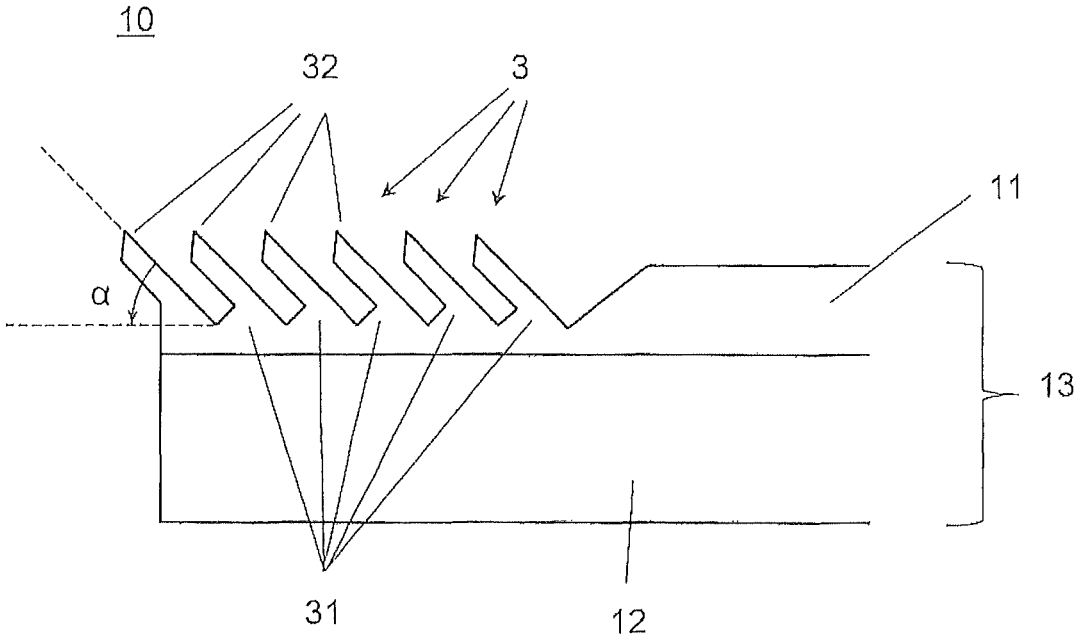
FIG. 2 shows a side view of a first component having linear lamellae.

FIG. 2 shows a side view of a first component 10 according to FIG. 1. The angle $\alpha$ which the sloping lamellae 3 enclose with an imaginary line that is parallel to the surface of the first component 10 is approximately 45°. There is no force acting on the lamellae 3. They are in their rest position.

Figure 3:
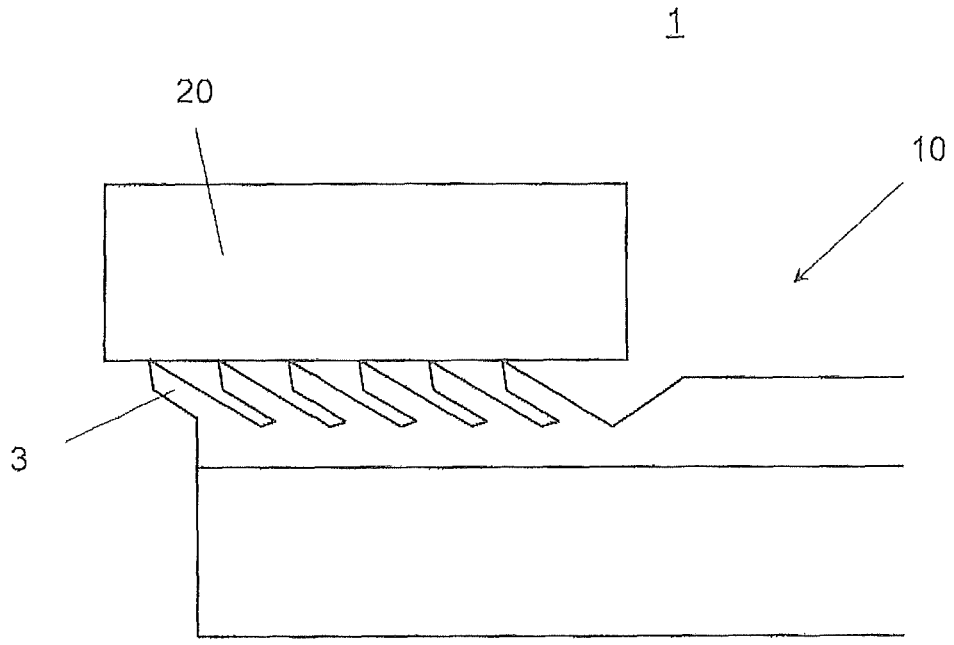
FIG. 3 shows an arrangement of a first component and of a second component.

FIG. 3 shows a side view of an arrangement 1 consisting of a first component 10 and of a second component 20. The first component 10 corresponds to the component 10 illustrated in FIG. 2. The lamellae 3 of the first component 10 are in contact with the second component 20. The second component 20 exerts a force in the direction of the first component 10 on the lamellae 3. The lamellae 3 are thereby deflected out of their rest position. They now slope more steeply toward the surface of the first component 10 than in the case of FIG. 2, and the angle which they enclose with the surface of the first component 10 is smaller than in the rest position. By virtue of the deflection out of the rest position, the lamellae 3 exert a spring force on the second component 20. This spring force brings about a contact pressure of the lamellae 3 against the surface of the second component 20. The higher the contact pressure, the lower is the electric transfer resistance between the lamellae 3 and the second component 20. Because the lamellae 3 are an integral constituent of the first component 10, there is no significant electric resistance between the first component 10 and the lamellae 3.

Figure 4:
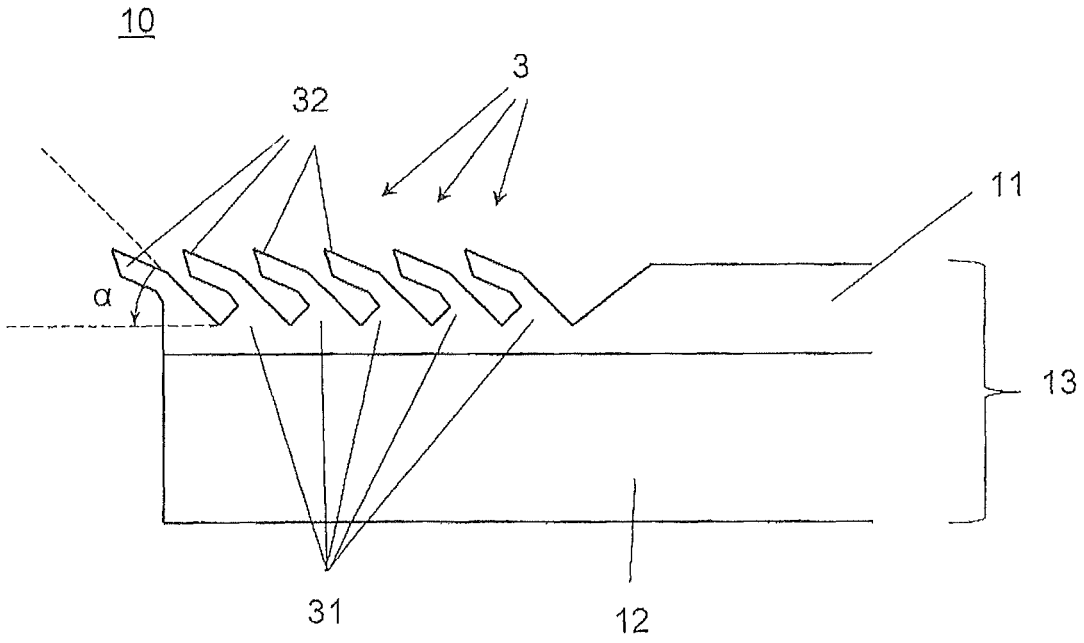
FIG. 4 shows a side view of a first component having lamellae with a kink.

FIG. 4 shows a side view of a first component 10 having lamellae 3 that have a kink. The lamellae 3 start at the surface of the first component 10 at the same slope angle $\alpha$ as the lamellae 3 on the component 10 illustrated in FIG. 2. At approximately half their width, the lamellae 3 have a kink. That part of a lamella 3 which is situated between the kink and the free end 32 of the lamella 3 encloses an angle which is smaller than the slope angle $\alpha$ with the surface of the first component 10 at the base of the lamella 3. If the lamellae 3 formed in this way are deflected out of their rest position by a second component 20, that part of the lamella 3 which is situated between the kink and the free end 32 hugs the surface of the second component 20 very well. The contact area available for the transfer of the current is thus enlarged.

Figure 5:
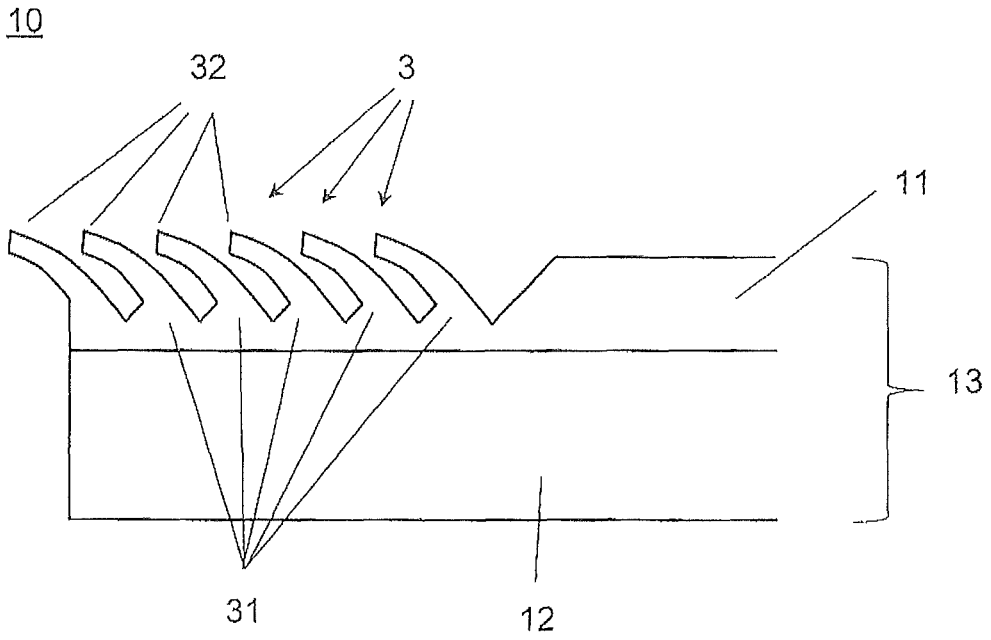
FIG. 5 shows a side view of a first component having convexly curved lamellae.

FIG. 5 shows a side view of a first component 10 having convexly curved lamellae 3. The lamellae 3 start at the surface of the first component 10 at the same slope angle as the lamellae 3 on the component 10 illustrated in FIG. 2. By virtue of the convex curvature of the lamellae 3, the angle which the tangent to the surface of the lamella encloses with the surface of the first component 10 changes continuously. It becomes steadily smaller. At the free end 32 of the lamellae 3, this angle is approximately the same size as the corresponding angle in the case of the lamellae 3 with a kink that are illustrated in FIG. 4. The effects and advantages described in conjunction with FIG. 4 also apply to the embodiment illustrated in FIG. 5.

Figure 6:
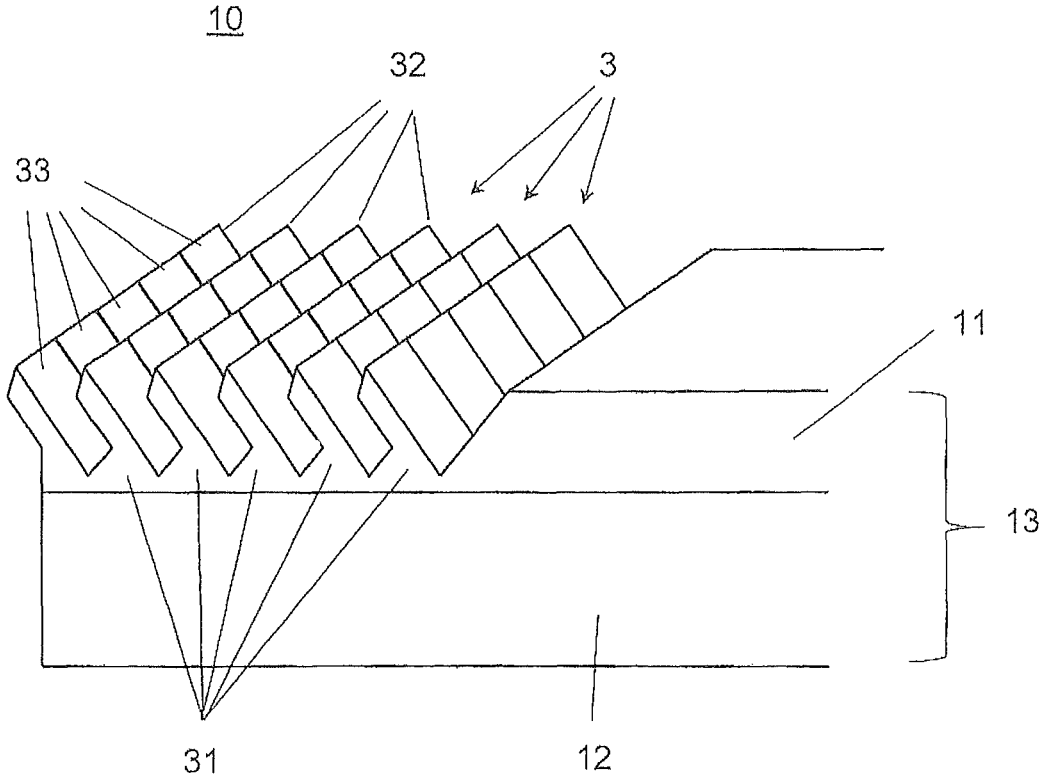
FIG. 6 shows schematically a first component having segmented lamellae.

FIG. 6 shows schematically a first component 10 having segmented lamellae 3. The component 10 illustrated here can be regarded as a development of the component 10 illustrated in FIG. 1. Starting from their free end 32, the lamellae 3 are each divided into a plurality of mutually adjacent segments 33 by cuts or slots. The cuts or slots can preferably extend into the connecting region 31 at the base of the lamellae. The individual segments 33 can be deflected independently of one another out of their respective rest position. This enables the lamella 3 to adapt better to irregularities in the surface of the second component 20. The contact area thus becomes larger.

Figure 7:
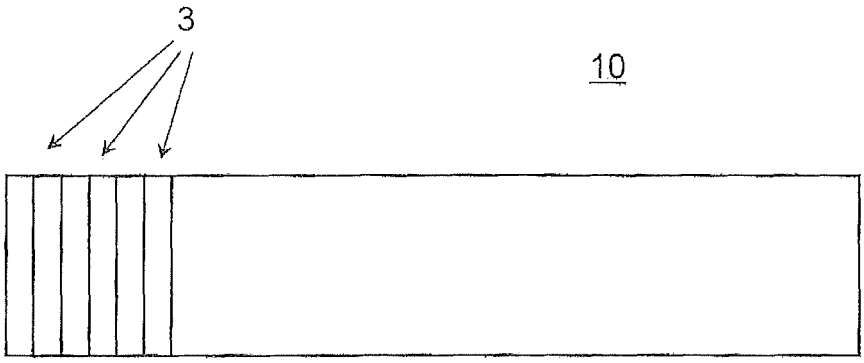
FIG. 7 shows a plan view of a first component having transversely extending lamellae.
Figure 8:
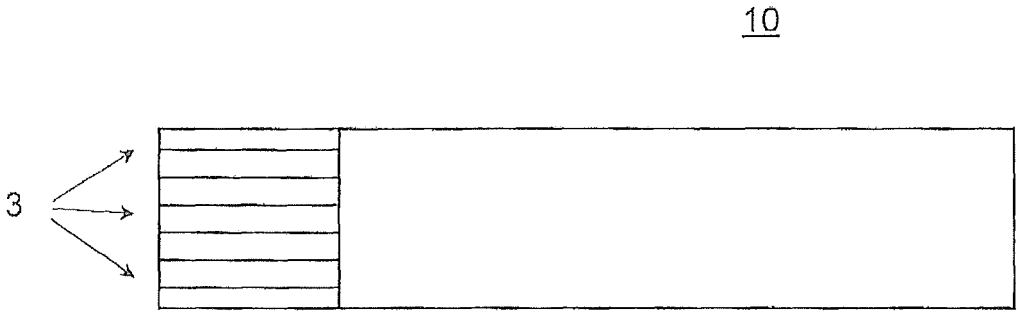
FIG. 8 shows a plan view of a first component having longitudinally extending lamellae.
Figure 9:
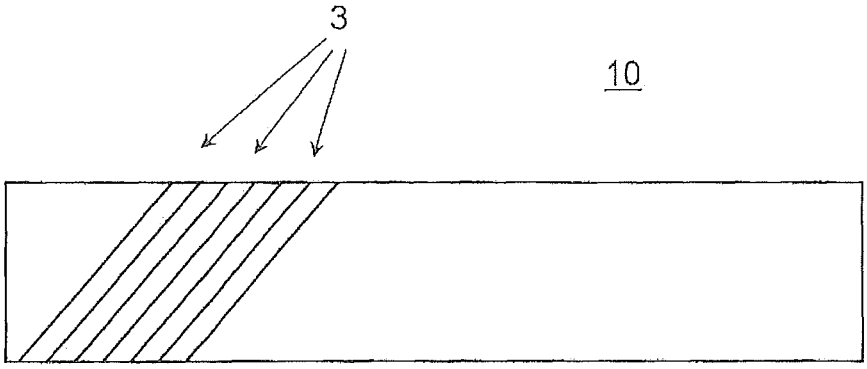
FIG. 9 shows a plan view of a first component having obliquely extending lamellae.

FIGS. 7, 8 and 9 each illustrate a plan view of a first component 10. The respective first components 10 in these figures differ in the alignment of the lamellae 3 relative to the longitudinal extent of the first component 10, which, by way of example, is embodied as a busbar in FIGS. 7, 8 and 9. In the illustrative embodiment illustrated in FIG. 7, the lamellae 3 are arranged transversely to the longitudinal extent of the busbar. In the illustrative embodiment illustrated in FIG. 8, the lamellae 3 are arranged parallel to the longitudinal extent of the busbar. In the illustrative embodiment illustrated in FIG. 9, the lamellae 3 are arranged obliquely to the longitudinal extent of the busbar. The embodiments illustrated show the great flexibility of the arrangement according to the invention for transferring electric current from a first to a second component.

The invention claimed is:

1. An arrangement of components for transferring electric current from a current-feeding component to a current-discharging component, the arrangement comprising:

a first component, the first component being the component feeding current to the arrangement or being the component discharging current from the arrangement, the first component comprising a first metallic material and, on at least one surface, having at least one spring lamella composed of the first metallic material and machined out of the first metallic material at said surface, the at least one spring lamella being machined out of the first metallic material at the surface of the first component by a separating process and by a bending process in such a way that the at least one spring lamella is connected monolithically to the first component in a connecting region, the first metallic material of the first component having a greater hardness in the connecting region than outside the connecting region, and, starting from the connecting region, the at least one spring lamella extends as far as a free end thereof, and, when the at least one spring lamella is deflected out of a rest position thereof in a direction toward the surface of the first component, the at least one spring lamella exerts a spring force directed away from the surface of the first component; and a second component, the second component being in immediate contact with the at least one spring lamella of the first component.

2. The arrangement according to claim 1, wherein only the first component and the second component are situated in a current path of the arrangement.

3. The arrangement according to claim 1, wherein the separating process comprises a cutting, chiseling, peeling, plowing or furrowing process.

4. The arrangement according to claim 1, wherein the at least one spring lamella extends obliquely at an angle of less than 80° to the surface of the first component in the rest position.

5. The arrangement according to claim 4, wherein the at least one spring lamella extends obliquely at an angle of from 40° to 70° to the surface of the first component in the rest position.

6. The arrangement according to claim 4, wherein the at least one spring lamella has a convex contour between the connecting region and the free end of the at least one spring lamella on a side facing away from the first component.

7. The arrangement according to claim 1, wherein the at least one spring lamella is divided into a plurality of segments, starting from the free end thereof.

8. The arrangement according to claim 1, wherein the first component is composed at least partially of a metallic composite material comprising the first metallic material and a second metallic material, the second metallic material having a higher electric conductivity than the first metallic material.

9. The arrangement according to claim 1, wherein the first component has an electrically insulating layer, the electrically insulating layer being at least partly removed on a side of the at least one spring lamella facing away from the surface of the first component.

10. The arrangement according to claim 1, wherein the connecting region is a first connecting region and the second component is composed at least partially of a metallic material and on at least one surface thereof has at least one spring lamella composed of the metallic material, the at least one spring lamella of the second component being machined out of the metallic material at surface of the second component in such a way that the at least one spring lamella of the second component is connected monolithically thereto in a second connecting region and, starting from the second connecting region, the at least one spring lamella of the second component extends as far as a free end thereof, and the at least one spring lamella of the second component is in contact with the at least one spring lamella of the first component.

11. The arrangement according to claim 10, wherein the at least one spring lamella of the first component is in contact with the at least one spring lamella of the second component in such a way that the first component remains connected to the second component when the first and second components change position relative to one another.

* * * * *